US009558899B2

(12) United States Patent
Kreuzpointner et al.

(10) Patent No.: US 9,558,899 B2
(45) Date of Patent: Jan. 31, 2017

(54) DIRECT-CURRENT CONTACTOR WITH ADDITIONAL SWITCHING CAPABILITY FOR AC LOADS AND A POLARITY AGAINST THE PREFERENTIAL CURRENT DIRECTION

(71) Applicant: Schaltbau GmbH, Munich (DE)

(72) Inventors: Korbinian Kreuzpointner, Schwaig (DE); Andrej Ignatov, Munich (DE); Robert Kralik, Poing (DE)

(73) Assignee: Schaltbau GmbH, Munich (DE)

( * ) Notice: Subject to any disclaimer, the term of this patent is extended or adjusted under 35 U.S.C. 154(b) by 0 days.

(21) Appl. No.: 14/674,300

(22) Filed: Mar. 31, 2015

(65) Prior Publication Data

US 2015/0287560 A1 Oct. 8, 2015

(30) Foreign Application Priority Data

Apr. 2, 2014 (DE) ..... 10 2014 004 843

(51) Int. Cl.
*H01H 33/18* (2006.01)
*H01H 33/08* (2006.01)
(Continued)

(52) U.S. Cl.
CPC ..... *H01H 33/182* (2013.01); *H01H 9/362* (2013.01); *H01H 9/44* (2013.01); *H01H 33/08* (2013.01); *H01H 33/18* (2013.01); *H01H 33/596* (2013.01)

(58) Field of Classification Search
CPC ..... H01H 9/362; H01H 9/44; H01H 9/443; H01H 33/08; H01H 33/182; H01H 33/18; H01H 33/20; H01H 33/596; H01H 1/20
(Continued)

(56) References Cited

U.S. PATENT DOCUMENTS 5,004,874 A * 4/1991 Theisen ..... H01H 1/20 218/151
5,761,025 A * 6/1998 Iversen ..... H02B 1/14 361/617
2013/0292359 A1* 11/2013 Kralik ..... H01H 33/20 218/148

FOREIGN PATENT DOCUMENTS

DE 69120170 T2 10/1996
DE 102010031907 B9 1/2013
(Continued)

OTHER PUBLICATIONS

Search Report mailed Feb. 11, 2015, from German Application No. 10 2014 004 843.8 (8 pages).

*Primary Examiner* — Renee Luebke
*Assistant Examiner* — William Bolton
(74) *Attorney, Agent, or Firm* — Kilpatrick Townsend & Stockton LLP

(57) ABSTRACT

Disclosed is a DC contactor comprising a double break with two contact points, each having a fixed and a movable contact, the movable contacts arranged on a contact bridge. The contactor includes an arc extinguishing device and a blowing device configured to blow a switch arc, which forms at the first contact point when the contact points are being opened, into the arc extinguishing device, when switching takes place in the preferential current direction. A commutating plate is arranged adjacent the movable contact of the first contact point, the contact bridge and the commutating plate being electrically insulated from one another and the commutating plate being potentially connected to the fixed contact of the second contact point, so that, when switching takes place in the preferential current direction, the switch arc forming at the first contact point jumps from the contact bridge to the commutating plate by the blowing device.

9 Claims, 3 Drawing Sheets

Figure 1:
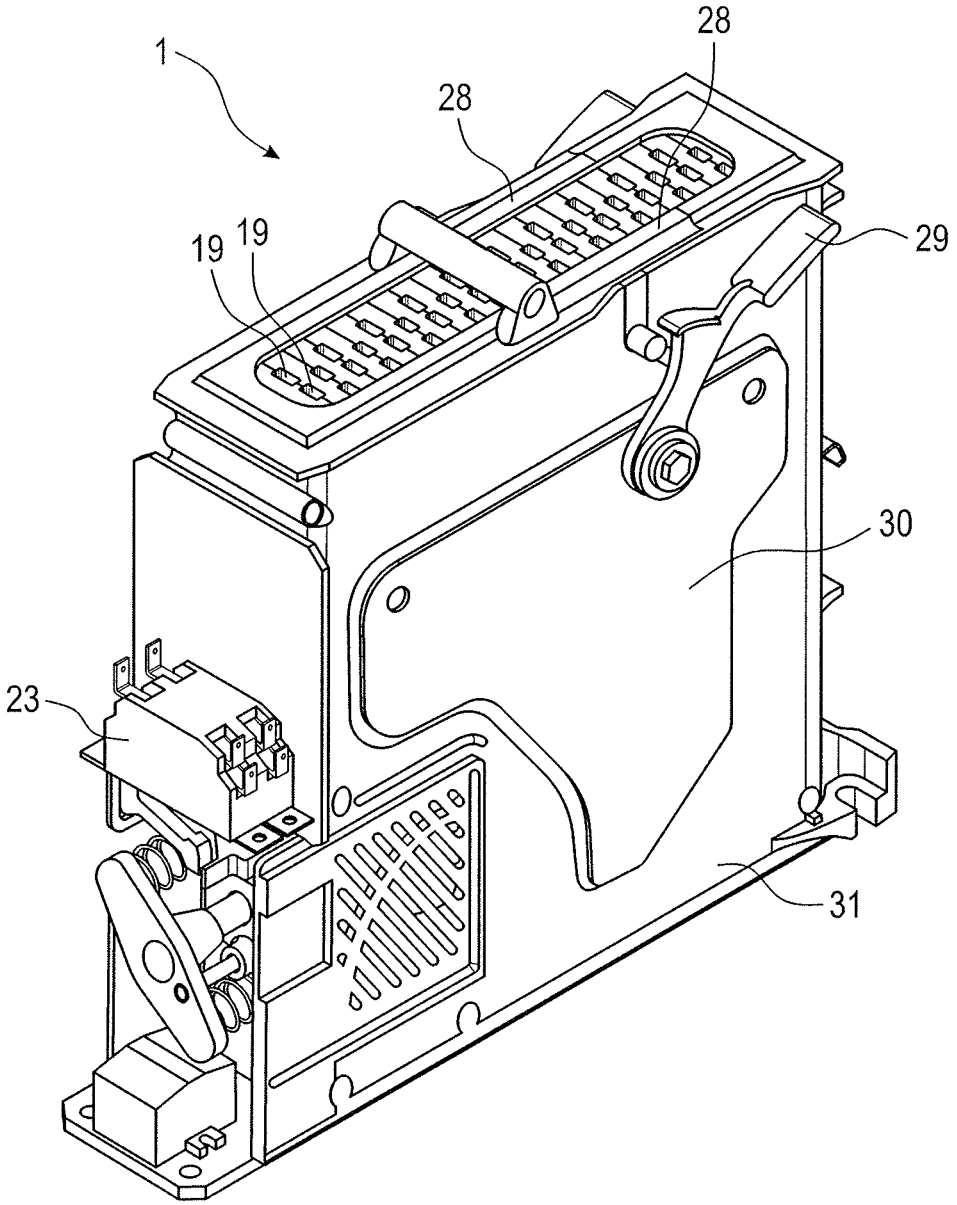

(51) Int. Cl.

| | |
|---|---|
| ***H01H 9/36*** | (2006.01) |
| ***H01H 9/44*** | (2006.01) |
| ***H01H 33/59*** | (2006.01) |

(58) Field of Classification Search
USPC ..... 218/26, 22, 23, 30, 31; 335/201, 202
See application file for complete search history.

(56) References Cited

FOREIGN PATENT DOCUMENTS

| | | | |
|---|---|---|---|
| EP | 0473013 | A2 | 3/1992 |
| EP | 2463876 | A1 | 6/2012 |
| EP | 2600371 | A1 | 6/2013 |
| RU | 28418 | U1 | 3/2003 |
| RU | 2 417 475 | C2 | 4/2011 |
| RU | 110 864 | U1 | 11/2011 |
| SU | 184953 | A1 | 7/1966 |

* cited by examiner

DIRECT-CURRENT CONTACTOR WITH ADDITIONAL SWITCHING CAPABILITY FOR AC LOADS AND A POLARITY AGAINST THE PREFERENTIAL CURRENT DIRECTION

This application claims priority to German Patent Application No. 10 2014 004 843.8, filed Apr. 2, 2014, the disclosure of which is incorporated by reference herein.

The present invention relates to a direct-current contactor with preferential current direction according to the preamble of the independent claim 1. A direct-current contactor of this type comprises a double break with two contact points, which each comprise a fixed contact and a movable contact. The movable contacts are arranged on a contact bridge. The direct-current contactor of the generic kind further comprises an electric arc extinguishing device as well as a blowing device, said blowing device being configured to blow a switch arc, which forms at the first contact point when the contact points are being opened, into the electric arc extinguishing device, when switching takes place in the preferential current direction. In addition, the direct-current contactor of the generic kind comprises a commutating plate, which is arranged adjacent the movable contact of the first contact point, the contact bridge and the commutating plate being electrically insulated from one another and the commutating plate being potentially connected (=has the same potential) to the fixed contact of the second contact point, so that, when switching takes place in the preferential current direction, the switch arc forming at the first contact point jumps from the contact bridge to the commutating plate due to the effect produced by the blowing device, thus bridging the switch arc formed at the second contact point.

A direct-current contactor of the generic kind is known e.g. from DE 10 2010 031 907 B9. The contactor has a very simple structural design and is used e.g. in railway applications for switching direct currents with a nominal voltage of up to 3 kV. Since in the case of the contactor of the generic kind, the second switch arc at the second contact point is bridged, when the first switch arc jumps from the contact bridge to the commutating plate, the second switch arc is simply extinguished. Only the first switch arc remains, which, in turn, is blown by the blowing device into the light arc extinguishing device and is extinguished there.

The requirements that have to be met by direct-current contactors in the field of railroad technology are particularly high in some cases. In this field, reversible or AC loads have to be switched sometimes, the reversible or AC switching loads to be switched being, however, normally much lower than the nominal switching loads during DC operation, when there is a flow of current in the preferential direction. Particularly low loads of this kind can also be switched with a direct-current contactor of the generic kind. The requirements that have to be met in the field of railroad technology by the contactors used become, however, increasingly higher. Hence, there is a need for direct-current contactors with improved switching capability for AC loads and a polarity against the preferential direction.

It is therefore the object of the present invention to provide a direct-current contactor of the generic kind with improved switching capability for AC loads and a polarity against the preferential direction.

This object is achieved by the features of the independent claim 1. Hence, a solution according to the present invention exists, when the direct-current contactor comprises an auxiliary electric arc extinguishing device, the blowing device being dimensioned and configured such that, due to the effect produced by the blowing device, the switch arc forming at the first contact point jumps, when switching takes place in a direction opposite to the preferential current direction, from the contact bridge to the fixed contact of the second contact point and is caused to pass between the two fixed contacts and into the auxiliary electric arc extinguishing device by means of blowing.

The invention offers a very simple solution for substantially improving the switching capability of the direct-current contactor of the generic kind for AC loads and a polarity against the preferential direction. The direct-current contactor according to the present invention additionally has a very simple structural design and can thus be produced easily and at a reasonable price.

The main electric arc extinguishing device of the direct-current contactor according to the present invention, which will be referred to as electric arc extinguishing device in the following, is only used when switching is effected in the preferential direction. It is preferably arranged adjacent the first contact point. The switch arc forming at the first contact point then only has to cover a short distance up to the electric arc extinguishing device and is therefore extinguished quickly. The contact bridge and the commutating plate are, again preferably, separated by an air gap. The commutating plate is, again preferably, configured as an electric arc deflector and encloses a boundary area of the electric arc extinguishing device at least partially. One of the light arc base points of the switch arc forming at the first contact point is, according to this embodiment, conducted on the electric arc deflector along the electric arc extinguishing device. The switch arc is thus stretched and blown into the electric arc extinguishing device.

Advantageous embodiments of the present invention are the subject matter of the subclaims.

According to a specially preferred embodiment of the present invention, the auxiliary electric arc extinguishing device is arranged between two contact rails, which connect the two fixed contacts to connecting contacts of the direct-current contactor. This allows the auxiliary electric arc extinguishing device to be accommodated in the direct-current contactor in a particularly space-saving manner, and a compact structural design of the entire direct-current contactor according to the present invention is obtained in this way. Preferably, the two contact rails have the function of conducting the switch arc into the auxiliary electric arc extinguishing device, and, consequently, each of them is configured as an electric arc deflector. The contact rail connected to the fixed contact of the first contact point simultaneously defines, again preferably, the second electric arc deflector for the electric arc extinguishing device and the first electric arc deflector for the auxiliary electric arc extinguishing device. The contact rail connected to the fixed contact of the second contact point defines preferably the second electric arc deflector for the auxiliary electric arc extinguishing device.

According to another preferred embodiment of the present invention, the auxiliary electric arc extinguishing device is dimensioned such that it is smaller than the electric arc extinguishing device. Since, normally, the direct-current contactor must exhibit a switching capability for AC loads and a polarity against the preferential direction only in exceptional cases and since the loads to be switched are then normally lower than the nominal switching load of the direct-current contactor, a particularly compact structural design is obtained in this way. The auxiliary electric arc extinguishing device comprises, again preferably, less extinguishing elements than the electric arc extinguishing device.

According to another preferred embodiment of the present invention, the electric arc extinguishing device and/or the auxiliary electric arc extinguishing device comprise a plurality of extinguishing elements made of ceramics. Ceramic extinguishing elements proved to be useful for extinguishing switch arcs. At least some of the extinguishing elements of the electric arc extinguishing device are, again preferably, combined so as to form an insert, which can be removed from outside so as to make the first contact point more easily accessible for the purpose of maintenance and inspection. In this context it will be particularly advantageous to configure the insert such that it can be locked and unlocked mechanically.

According to another preferred embodiment of the present invention, flow passages are formed between the extinguishing elements, said flow passages being each provided with a dispersing portion, the dispersing portions of neighboring flow passages being configured such that they have different inclinations, so that the gases discharged from the extinguishing elements will be fanned out. This embodiment has the advantage that plasma generated by the switch arc can be removed particularly quickly. The switch arc is thus extinguished within a particularly short period of time.

According to another preferred embodiment of the present invention, the contact bridge narrows at an end facing the commutating plate. Preferably, the contact bridge is configured such that it tapers at this end. This has the effect that, when there is a flow of current in the preferential current direction, the switch arc will jump to the commutating plate quickly and reliably.

According to another preferred embodiment of the present invention, the blowing device includes a permanent magnet disposed adjacent to an end of the contact bridge, a ceramic protection element being arranged between the permanent magnet and the end of the contact bridge. Thus, the permanent magnet is protected against damage through the switch arc. The protection element is preferably plate-shaped. The permanent magnet is, again preferably, arranged at the end of the contract bridge facing the commutating plate.

According to another preferred embodiment of the present invention, the commutating plate is covered, at least partially, by a shield element on an outer side facing away from the electric arc extinguishing device. Additional electric and/or electronic components of the direct-current contactor can thus be arranged in the area of the outer side of the commutating plate, without parasitic effects and/or damage being caused by the switch arc. The electric or electronic components may e.g. be part of the control unit of the direct-current contactor, or they may be auxiliary switches.

According to another preferred embodiment of the present invention, the contact points and the commutating plate are insulated, at least in certain areas thereof, from a drive and/or a control unit of the direct-current contactor by means of an insulating foil. A more compact structural design can thus be accomplished with due regard to the demanded air gaps and leakage paths. In order to prevent the insulating foil from burning off in the area of the second contact point, a protective cover is preferably arranged between the insulating foil and the second contact point. This protective cover is preferably plate-shaped and made of steel.

Figure 2:
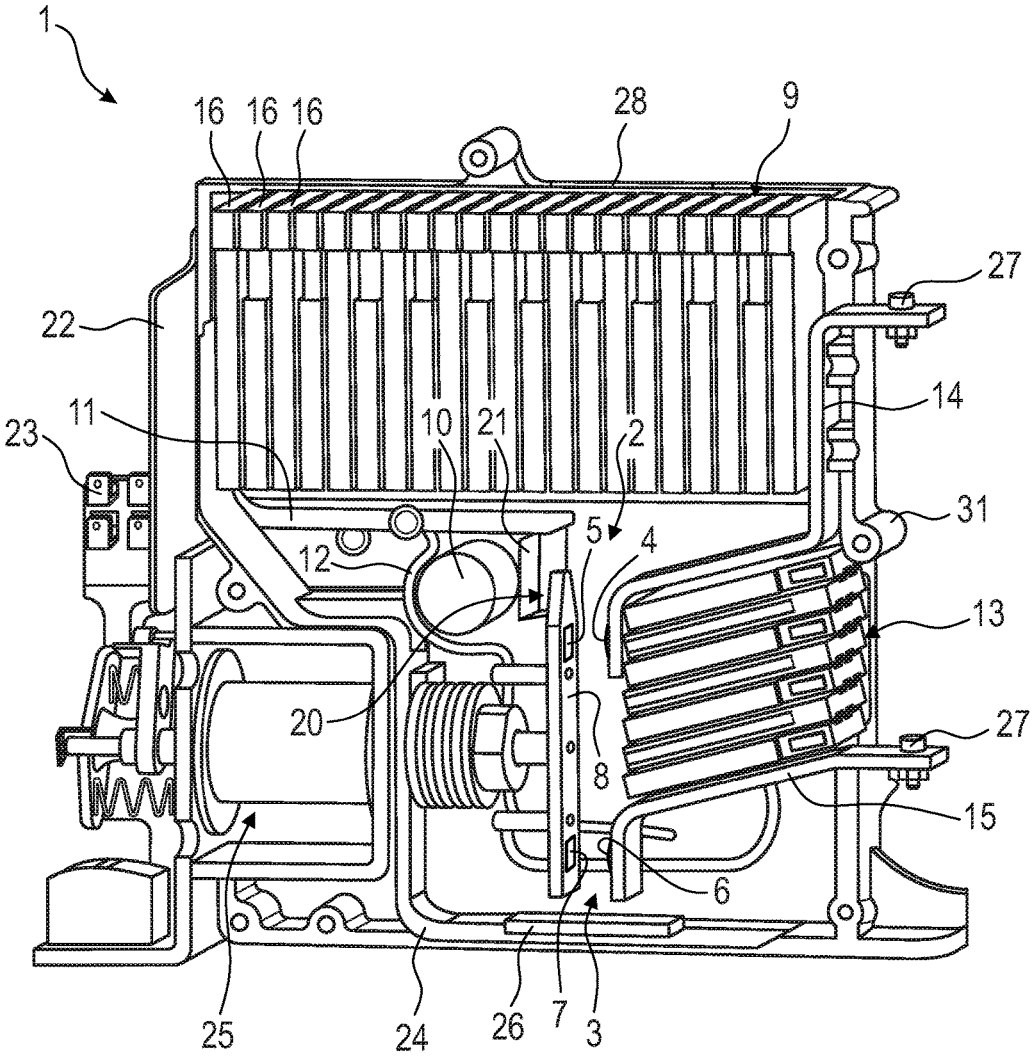
Figure 3:
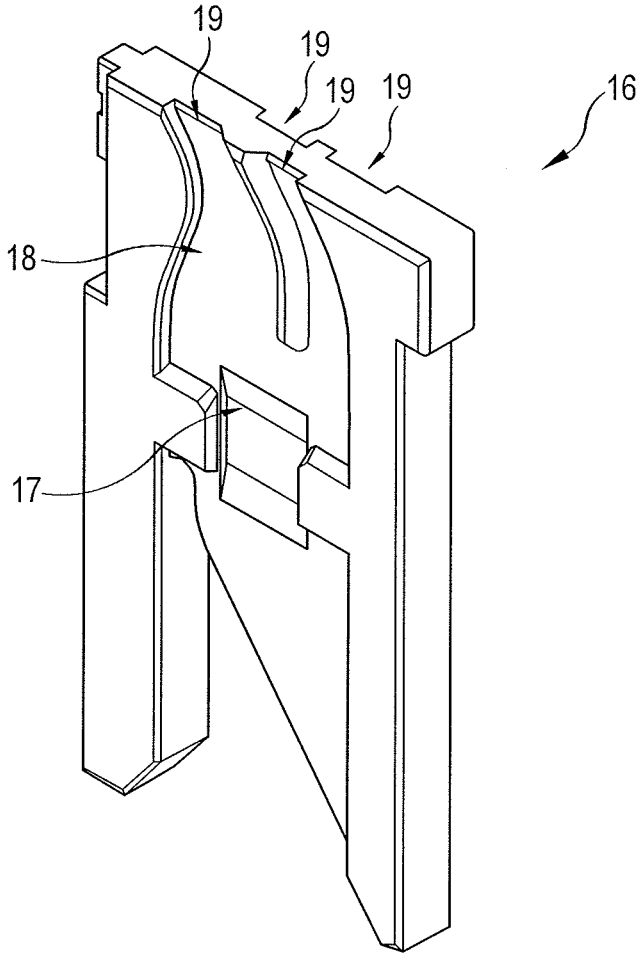

In the following, an advantageous embodiment of the present invention will be explained in more detail making reference to drawings, in which:

FIG. 1 shows an oblique view of a direct-current contactor according to the present invention, FIG. 2 shows the direct-current contactor according to the present invention according to FIG. 1 in a partially open condition of the housing, and FIG. 3 shows a detail view of one of the extinguishing elements of the direct-current contactor according to the present invention according to FIGS. 1 and 2.

In the statements following hereinbelow like parts are designated by like reference numerals. If a drawing comprises reference numerals which are not discussed in detail in the associated description of the figure, reference is made to preceding or subsequent descriptions of figures.

An oblique view of a direct-current contactor 1 according to the present invention is shown in FIG. 1. The interior structural design of the direct-current contactor 1 is shown in FIG. 2. The direct-current contactor 1 includes a double break with two contact points 2 and 3. The first contact point consists of a fixed contact 4 and a movable contact 5, the second contact point 3 comprises a fixed contact 6 and an associated movable contact 7. The two movable contacts 5 and 7 are arranged on a contact bridge 8. The contact bridge 8 is actuated by an electromagnetic drive 25 that is controlled by means of the control unit 23. The control unit 23 is here arranged outside of the housing 31 of the direct-current contactor 1 according to the present invention and is therefore also visible in FIG. 1. Each of the two fixed contacts 4 and 6 is connected to a respective connecting contact 27 of the direct-current contactor via a contact rail 14 and 15, respectively.

When the contact points are opened, a switch arc forms, which must be extinguished as quickly as possible so as to avoid damage to the contacts or other components of the direct-current contactor. To this end, the direct-current contactor 1 is provided with an electric arc extinguishing device 9 as well as a blow device 10 consisting essentially of a permanent magnet. The magnetic field of the permanent magnet 10 is oriented such that a switch arc forming at the first contact point 2 when there is a flow of current in the preferential current direction is driven into the electric arc extinguishing device 9. In order to ensure that the magnetic field is built up at the decisive points, suitable pole plates 30, which are known from the prior art, are arranged on both sides of the housing. One of the two pole plates is shown in FIG. 1.

The direct-current contactor 1 according to the present invention is provided with a so-called commutating plate 11, which begins close to the first contact point 2 and which abuts in a clamplike manner on the left boundary area of the electric arc extinguishing device 9. Via a connecting wire 12, the commutating plate 11 is potentially connected to the fixed contact 6 of the second contact point. When there is a flow of current in the preferential direction, the switch arc forming at the first contact point jumps, due to the effect produced by the magnetic field, from the contact bridge 8 to the commutating plate 11, thus bridging the switch arc that forms at the second contact point. The commutating plate 11 and the contact rail 14 connected to the first fixed contact 4 then act as electric arc deflectors. By means of these electric arc deflectors, the switch arc forming at the first contact point 2 is stretched while it is being blown into the electric arc extinguishing device 9 by the permanent magnet 10. Fast and reliable extinguishing of the switch arc is accomplished in this way.

In order to support the switch arc in jumping from the contact bridge 8 to the commutating plate 11, the contact bridge end 20 located at the contact point 2 is configured such that it tapers. For preventing the switch arc from striking through from the contact bridge 8 to the permanent magnet 10 arranged adjacent thereto, a platelike ceramic protection element 21 is disposed between the end 20 of the contact bridge 8 and the permanent magnet 10.

When the fixed contacts of the direct-current contactor according to the present invention have applied thereto a voltage poled in a direction opposite to the preferential direction, the switch arc forming at the first contact point 2 cannot be extinguished by the electric arc extinguishing device 9. In this case, the magnetic field of the permanent magnet 10 ensures that the switch arc forming at the first contact point 2 will be blown downwards away from the electric arc extinguishing device 9. For guaranteeing a reliable extinction of the switch arc also in this case, the direct-current contactor according to the present invention is provided with an auxiliary electric arc extinguishing device 13. This device 13 is located between the two contact rails 14 and 15 of the two fixed contacts 4 and 6. Due to the effect produced by the magnetic field, the switch arc forming at the first contact point 2 is driven along the contact bridge 8 from the movable contact 5 of the first contact point in the direction of the movable contact 7 of the second contact point and, in the course of this process, it jumps to the neighboring fixed contact 6 of the second contact point and merges with the switch arc forming at the second contact point 3. The switch arc forming at the second contact point 3 is extinguished in any case as soon as the switch arc forming at the first contact point jumps from the contact bridge 8 to the fixed contact 6 of the second contact point 3. From this moment onwards, the two contact rails 14 and 15 act as electric arc deflectors. Through the blowing effect produced by the permanent magnet 10, the switch arc is driven along these two electric arc deflectors into the auxiliary electric arc extinguishing device 13 where it is extinguished. Hence, the direct-current contactor according to the present invention is also suitable for switching off currents flowing in a direction opposite to the preferential direction and AC loads safely and reliably up to a certain level. For achieving a compact structural design, the contact points and the commutating plate are insulated from the drive unit and the control unit by an insulating foil 24. In order to prevent the insulating foil from burning off in the area of the second contact point 3 due to the switch arc forming at the contact point 3, said insulating foil 24 is, in this area, covered by a protective cover in the form of a small steel plate 26. In order to protect the control unit 23 against parasitic influences, a shield element 22 is disposed between the control unit 23 and the commutating plate 11 and the electric arc extinguishing device 9, respectively.

Both the electric arc extinguishing device 9 and the auxiliary electric arc extinguishing device 13 consist of a plurality of ceramic extinguishing elements 16. One of the extinguishing elements is shown in detail in FIG. 3. As can clearly be seen from FIG. 3, two respective neighboring extinguishing elements have formed between them a flow passage 17 through which the plasma generated by the switch arc is conducted to the outside. Towards the discharge end 19, the flow passage includes a dispersing portion 18, the dispersing portions of neighboring flow passages being configured such that they have different inclinations, so that the gases discharged from the extinguishing elements will be fanned out. The plasma generated by the switch arc can be removed more quickly in this way, and also the switch arc can thus be extinguished within a shorter period of time.

For the purpose of maintenance and inspection, some of the extinguishing elements of the electric arc extinguishing device 9 may be removed, without it being necessary to disassemble the housing 31 of the direct-current contactor according to the present invention. The removable extinguishing elements are combined by means of the clips 28 shown in FIGS. 1 and 2 so as to form a removable insert. The latter can be locked and unlocked by means of the latch 29 shown in FIG. 1. The insert comprises the extinguishing elements through which the first contact point 2 is concealed. By removing the insert, the contacts can adequately be checked.

The invention claimed is:

1. A direct-current contactor with preferential current direction, comprising a double break with two contact points, which each comprise a fixed contact and a movable contact, the movable contacts being arranged on a contact bridge, and further comprising an electric arc extinguishing device as well as a blowing device, said blowing device being configured to blow a switch arc, which forms at the first contact point when the contact points are being opened, into the electric arc extinguishing device, when switching takes place in the preferential current direction, wherein a commutating plate is arranged adjacent the movable contact of the first contact point , wherein the contact bridge and the commutating plate are electrically insulated from one another, and wherein the commutating plate is potentially connected to the fixed contact of the second contact point, so that, when switching takes place in the preferential current direction, the switch arc forming at the first contact point jumps from the contact bridge to the commutating plate due to the effect produced by the blowing device thus bridging the switch arc formed at the second contact point, wherein the direct-current contactor comprises an auxiliary electric arc extinguishing device , the blowing device being dimensioned and configured such that, due to the effect produced by the blowing device, the switch arc forming at the first contact point jumps, when switching takes place in a direction opposite to the preferential current direction, from the contact bridge to the fixed contact of the second contact point and is caused to pass between the two fixed contacts and into the auxiliary electric arc extinguishing device by means of blowing; and wherein the auxiliary electric arc extinguishing device is arranged between two contact rails, which connect the two fixed contacts to connecting contacts of the direct-current contactor.

2. The direct-current contactor according to claim 1, wherein the auxiliary electric arc extinguishing device is dimensioned such that it is smaller than the electric arc extinguishing device.

3. The direct-current contactor according to claim 1, wherein the electric arc extinguishing device and/or the auxiliary electric arc extinguishing device comprise a plurality of extinguishing elements made of ceramics.

4. The direct-current contactor according to claim 3, wherein flow passages are formed between the extinguishing elements, said flow passages being each provided with a dispersing portion, the dispersing portions of neighboring flow passages being configured such that they have different inclinations, so that the gases discharged from the extinguishing elements will be fanned out.

5. The direct-current contactor according to claim 1, wherein the contact bridge narrows at an end facing the commutating plate.

6. The direct-current contactor according to claim 1, wherein the blowing device includes a permanent magnet disposed adjacent to an end of the contact bridge, a ceramic protection element being arranged between the permanent magnet and the end of the contact bridge.

7. The direct-current contactor according to claim 1, wherein the commutating plate is covered, at least partially, by a shield element on an outer side facing away from the electric arc extinguishing device.

8. The direct-current contactor according to claim 1, wherein the contact points and the commutating plate are insulated, at least in certain areas thereof, from a drive and/or a control unit of the direct-current contactor by means of an insulating foil.

9. The direct-current contactor according to claim 8, wherein a protective cover is arranged between the insulating foil and the second contact point.

* * * * *